US005791171A

United States Patent [19]

Kelley

[11] Patent Number: 5,791,171

[45] Date of Patent: Aug. 11, 1998

[54] SCISSOR LOCK WITH REMOVABLE CABLE ADAPTER

[75] Inventor: Donald W. Kelley, Fremont, Calif.

[73] Assignee: Qualtec Data Products, Inc., Fremont, Calif.

[21] Appl. No.: 800,094

[22] Filed: Feb. 12, 1997

[51] Int. Cl.[6] ..... E05B 69/00

[52] U.S. Cl. ..... 70/58; 70/14; 70/57; 248/551

[58] Field of Search ..... 70/14, 58, 423, 70/424; 248/551–553

[56] References Cited

U.S. PATENT DOCUMENTS

| | | | |
|---|---|---|---|
| D. 337,040 | 7/1993 | Carl et al. | D8/331 |
| D. 337,041 | 7/1993 | Carl | D8/331 |
| D. 346,733 | 5/1994 | Carl et al. | D8/343 |
| D. 347,987 | 6/1994 | Carl et al. | D8/343 |
| 934,928 | 9/1909 | Michel | 70/423 |
| 2,383,397 | 8/1945 | Lofqwist | 70/424 |
| 4,003,228 | 1/1977 | Lievens et al. | 70/58 |
| 4,057,984 | 11/1977 | Avaiusini | 70/58 |
| 4,938,040 | 7/1990 | Humphreys, Jr. | 70/58 |
| 5,050,836 | 9/1991 | Makous | 248/553 |
| 5,076,079 | 12/1991 | Monoson et al. | 70/58 |
| 5,082,232 | 1/1992 | Wilson | 248/551 |
| 5,327,752 | 7/1994 | Myers et al. | 70/58 |
| 5,381,685 | 1/1995 | Carl et al. | 70/78 |
| 5,493,878 | 2/1996 | Murray, Jr. et al. | 70/58 |
| 5,502,989 | 4/1996 | Murray, Jr. et al. | 70/58 |

FOREIGN PATENT DOCUMENTS

| | | |
|---|---|---|
| 877220 | 11/1940 | France . |
| 1085107 | 6/1953 | France . |
| 451949 | 10/1949 | Italy . |
| 14095 | 5/1905 | Norway . |

OTHER PUBLICATIONS

Product Description: Kensington® MicroSaver® Security System, Kensington Microwave Limited, Feb. 1992.

Product Description: Qualtec® Stop Theft™ PC Security Solutions, Qualtec Data Products, 1995, See Notebook-Kit and Macintosh Security.

*Primary Examiner*—Suzanne Dino Barrett

*Attorney, Agent, or Firm*—Fliesler, Dubb, Meyer & Lovejoy LLP

[57] ABSTRACT

A security device for securing a first object having an aperture to a second object. The security device includes a scissor locking unit for securing the device to the first object and a cable adapter. The scissor locking unit comprises a locking mechanism having a shaft that is rotated between an unlock position and a lock position, a cam connected to said shaft for rotation therewith and a scissor pivot assembly connected to the cam for translating the rotary motion of the cam into linear motion of a pair of scissor arms in the scissor pivot assembly. The pair of scissor arms will be in an overlapping closed position when the locking mechanism is in the unlock position allowing the scissor arms to be inserted into the aperture in the first object. The pair of scissor arms will be in a spread apart open position when the locking mechanism is in the lock position preventing the scissor arms from being withdrawn through the aperture in the first object so as to secure the device to the first object. The cable adapter first receives and houses a connector attached to the end of a cable where the cable has been attached to the second object and then receives the scissor locking unit so as to prevent the connector from being removed from the cable adapter. The cable adapter cannot be separated from the scissor locking unit after the scissor locking unit is attached to the first object.

12 Claims, 4 Drawing Sheets

FIGURE 10A
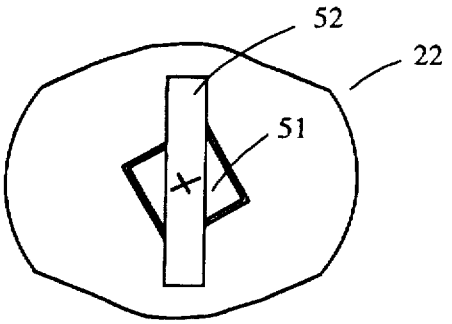
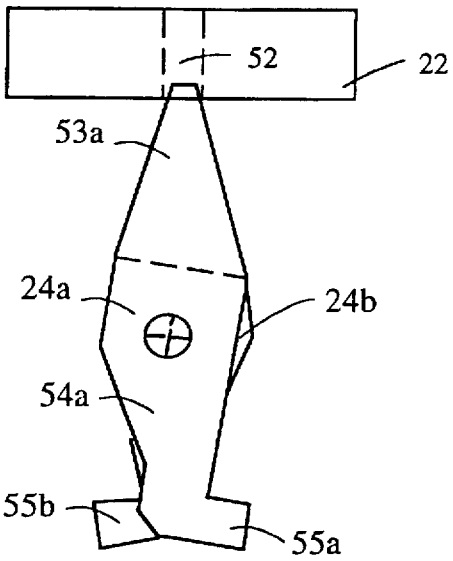
FIGURE 10B
FIGURE 11A
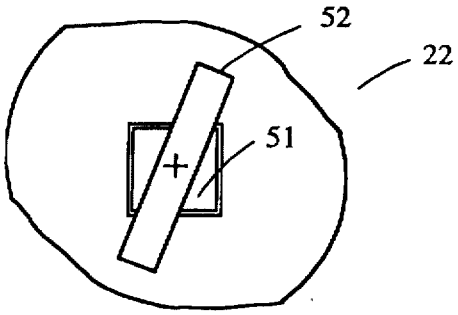
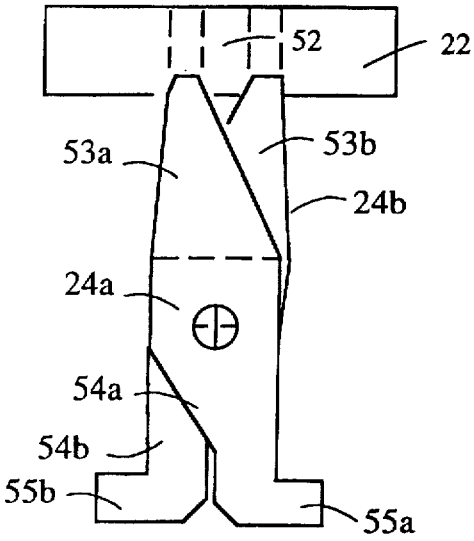
FIGURE 11B
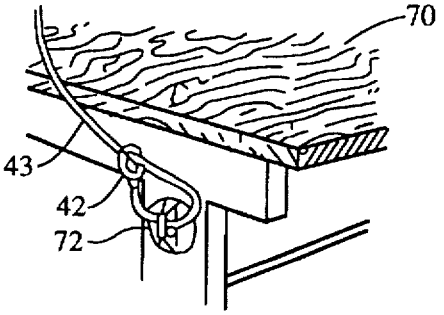
FIGURE 12
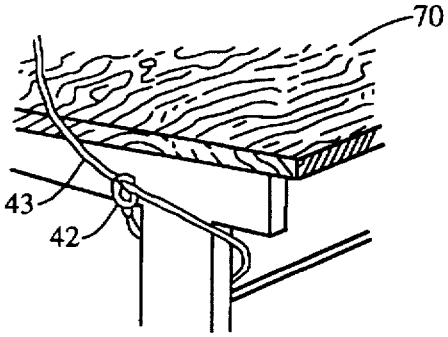
FIGURE 13

SCISSOR LOCK WITH REMOVABLE CABLE ADAPTER

BACKGROUND OF THE INVENTION

1. Field of the Invention

The present invention generally relates to a scissor locking mechanism and a removable cable adapter and more specifically relates to a scissor locking mechanism and a removable cable adapter for use in securing business equipment such as printers, scanners and portable computers and other portable objects in a location.

2. Description of the Related Art

Manufacturers of portable computers, such as lap top computers, and other portable objects, such as printers, scanners, copiers and modems, are providing a standardized and dedicated locking aperture within the body of the portable computer or other equipment. The locking aperture is so located that the equipment may still be operated when secured in a location by a locking apparatus.

Many different locking apparatuses have been developed to secure the equipment at a location. One such locking apparatus is the NOTEBOOK-KIT sold and manufactured by QUALTEC™ Data Products located at 47767 Warm Springs Boulevard, Fremont, Calif. 94539. The NOTEBOOK-KIT includes a scissor assembly comprised of a set of pivotal connected scissor arms where each arm has an engagement end and a lock receiving end, having a lock receiving hole therein. The scissor assembly when in an open position allows the engagement end of each arm to be inserted through the locking aperture into the housing of the object. The scissor assembly when in a closed position allows the engagement end of each arm to be spread apart such that the scissor assembly cannot be removed from the housing of the object through the locking aperture. Further when in the closed position the lock holes in each scissor arm are aligned for receiving a locking mechanism to prevent the scissor apparatus from being changed from the closed to the open position. A cable can be secured by the same locking mechanism and to a desired object thereby securing the portable object to the desired object.

SUMMARY OF THE INVENTION

It is an object of the present invention to incorporate the scissor locking feature of the scissor apparatus with the locking mechanism into a scissor lock unit.

It is another object of the present invention to provide a cable adapter that coacts with the scissor lock unit for securely receiving one end of a cable.

Finally, it is another object of the invention to provide a theft deterrent structure comprised of a scissor lock unit and a cable adapter that when used together provide a secure means for attaching a cable to a portable computer or other portable object.

Briefly the invention comprises a key operated scissor lock structure that linearly moves a pair of scissor arms between open and closed positions as a key .inserted into the lock is rotated between open and closed positions. A cable adapter allows one end of the scissor locking structure to pass through the cable adapter such that when the scissor locking structure is inserted through a locking aperture in a given object and then locked, the cable adapter cannot thereafter be removed from the scissor locking structure until the scissor locking structure is unlocked and removed from the portable unit. The cable adapter includes a compartment for receiving one end of a cable which is locked in place when the scissor locking structure is inserted through the cable adapter.

BRIEF DESCRIPTION OF THE DRAWINGS

The invention will be described with respect to the particular embodiments thereof and references will be made to the drawings, in which:

FIG. 10 illustrates the relationship of the scissor arms to the cam when the scissor locking unit is unlocked;

FIG. 11 illustrates the relationship of the scissor arms to the cam when the scissor locking unit is locked;

FIG. 12 illustrates a first way of connecting a cable to a structure; and

FIG. 13 illustrates a second way of connecting a cable to a structure.

DETAILED DESCRIPTION OF THE INVENTION

Figure 1:
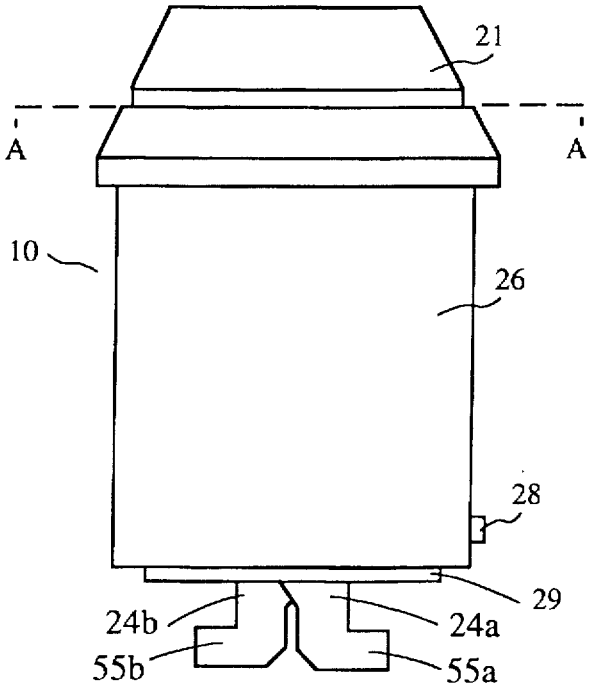
FIG. 1 is a plan view of the scissor locking unit of the invention.
Figure 3:
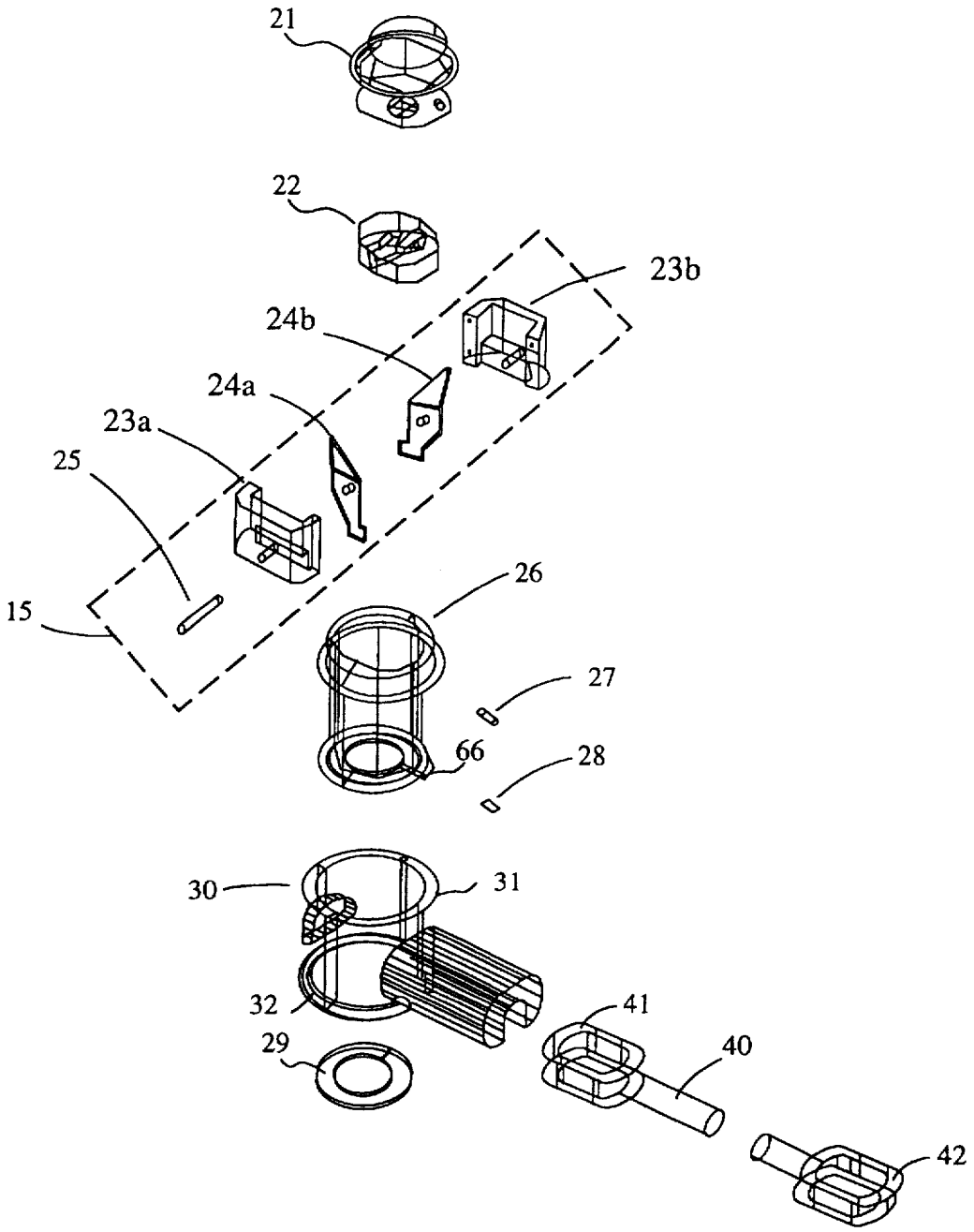
FIG. 3 is an exploded wire drawing view of the scissor locking unit and the cable adapter of the invention.
Figure 4:
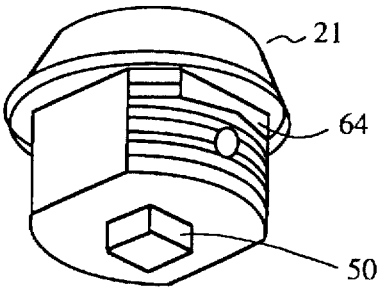
FIG. 4 is a front view of the lock component of the scissor locking unit.
Figure 7:
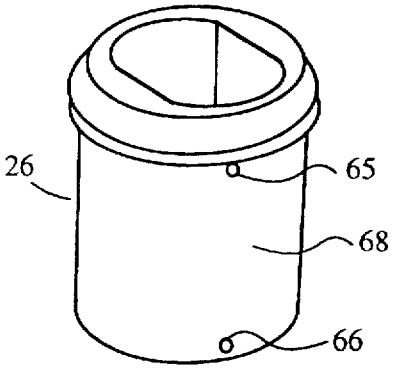
FIG. 7 is an isometric view of the sleeve component of the scissor locking unit.

FIG. 1 shows an assembled scissor locking unit 10 of the invention. At the top of the scissor locking unit 10 a key operated lock 21 is provided for operating scissor arms 24*a* and 24*b*. Referring to FIGS. 3, 4 and 7, lock 21 is securely mounted in sleeve 26 by pin 27 being force-fitted through hole 65 in sleeve 26 into mounting slit 64. Engagement end 55a of scissor arm 24*a* and engagement end 55*b* of scissor arm 24*b* extend from the bottom of sleeve 26. Seal 29 is provided to form a non-abrasive surface that will be in contact with the portable computer or portable object.

FIG. 3 is a wire diagram showing an exploded view of scissor locking unit 10, a cable adapter 30 and a cable 40. As shown in FIGS. 3 and 4, lock 21 is a standard commercially available key lock except that the shaft 50 of lock 21 has been machined preferably into a square shaft 50. Shaft 50 will rotate as an inserted key (not shown) into lock 21 is rotated.

Figure 5:
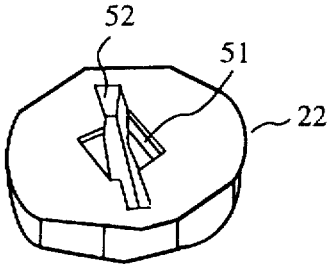
FIG. 5 is an isometric view of the cam component of the scissor locking unit.

As shown in FIGS. 3, 5 and 7, a cam 22 is provided having a square shaft receiving compartment 51 and translation slot 52 therein. Shaft 50 of lock 21 is inserted into the shaft receiving compartment 51 of cam 22 such that cam 22 will rotate as shaft 50 is rotated. Cam 22 is designed to rotate within sleeve 26. Shaft 50 and shaft receiving compartment 51 are not limited to a square structure but may take the form of any interlocking structure such as a rectangle, a triangle, a hexagon, etc.

Figure 6:
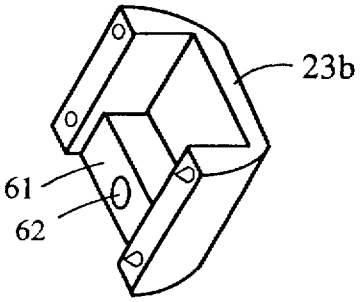
FIG. 6 is an isometric view of one half of the clamp component of the scissor locking unit.

FIG. 3 shows a scissor pivot assembly 15 formed from clamps 23a and 23b, scissor arms 24a and 24b and pivot pin 25. FIGS. 3 and 6 show clamp 23b to include bar 61 with pivot hole 62 therein. Clamp 23a is made identical to clamp 23b such that when the clamps 23a and 23b face each other as shown in FIG. 3 the two clamps will mate with each other to form a scissor housing into which scissor arms 24a and 24b are mounted by means of pivot pin 25.

Figure 8A:
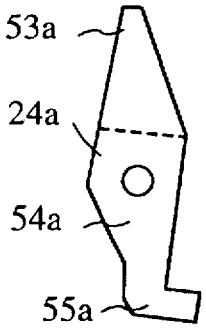
FIGS. 8A and 8B is a front and side view respectively of a scissor arm of the scissor locking unit.
Figure 8B:
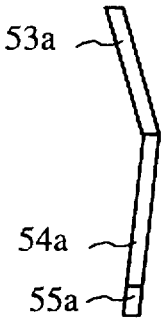

FIGS. 8A and 8B shows scissor arm 24a to include a translation portion 53a and a bottom portion 54a which terminates in engagement end 55a. The translation portion 53a has a truncated right triangle shape which is bent away from the vertical bottom portion 54a. Scissor arm 24b is made identical to scissor arm 24a such that when the scissor arms 24a and 24b face each other as shown in FIG. 3, the two translation portions 53a and 53b will extend away from each other, thereby allowing freedom of movement for the scissor arms 24a and 24b about pivot pin 25 in the scissor pivot assembly 15. The translation portions 53a and 53b extend into opposite sides of translation slot 52 in cam 22. As cam 22 is rotated, the structure of the scissor arms will translate the rotary motion of the cam 22 into linear motion of the engagement end 55a and 55b of bottom portion 54a and 54b of scissor arms 24a and 24b respectively.

Referring to FIGS. 3 and 7, a seal 29, made of rubber or plastic, is attached to the bottom of sleeve 26 for providing a non abrasive bottom surface for the scissor locking unit 10. Seal 29 is securely mounted in sleeve 26 by adhesive or by a force fitting.

Referring to FIGS. 2, 3, 7 and 9, key pin 28 is force fitted into blind hole 66 in sleeve 26 to provide a means for keying and holding scissor locking unit 10 within cable adapter 30. Cable adapter 30 has a key slot 31 through which key pin 28 passes to gain access to locking groove 32 in sleeve 30. In practice, scissor locking unit 10 is first oriented by key pin 28 to key slot 31 in cable adapter 30 and then scissor locking unit 10 is moved down through key slot 31 into cable adapter 30 and positioned such that key pin 28 is aligned with locking groove 32 in cable adapter 30. Scissor locking unit 10 is then rotated in either direction such that key pin 28 is engaged in locking groove 32 thereby securing scissor locking unit 10 within cable adapter 30. When scissor locking unit 10 is so inserted into cable adapter 30, key operated lock 21 will extend from the top of cable adapter 30 and the bottom surface of seal 29 and engagement end 55a of scissor arm 24a and engagement end 55b of scissor arm 24b will extend from the bottom of cable adapter 30.

Figure 9:
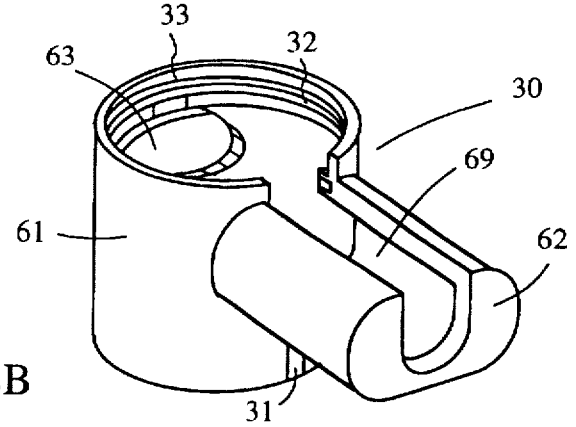
FIG. 9 is an isometric view of the cable adapter of the invention.

FIGS. 3 and 9 show the cable adapter 30 having a ring portion 61 which has an inner diameter greater than the outer diameter of the lower portion 68 of sleeve 26. A cable 40 is shown having both ends of cable 40 terminated with eye connector 41 and 42. The size of the eye in eye connector 40 is large enough to allow the eye connector at the opposite end of cable 40 to pass through that eye connector's eye. Cable adapter 30 has an eye connector housing 62 which is large enough to house eye connector 41 or 42 of cable 40. An insertion hole 63 in ring 61 and an insertion slot 69 in eye connector housing 62 are provided to ease the insertion of an eye connector into the eye connector housing 62.

Figure 2:
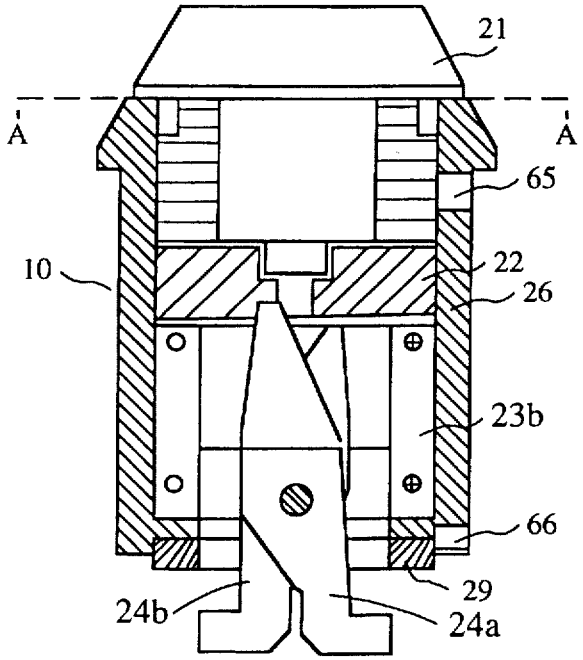
FIG. 2 is a cross section view illustrating the assembly of the various components of the scissor locking unit of the invention.

FIG. 2 illustrates the relative positions of the various components of the scissor locking unit 10. Sleeve 26, cam 22 and seal 29 have been sectioned along line A—A and clamp 23a has been omitted to expose other components in the scissor locking unit 10. Lock 21 is shown inserted into sleeve 26 with shaft 50 being housed in receiving compartment 51 of cam 22. Clamp 23b is shown inside sleeve 26 and supporting scissor arms 24a and 24b upon pivot pin 25. Translation portion 53a and 53b of scissor arms 24a and 24b respectively are shown as extending into translation slot 52 of cam 22.

FIG. 10 illustrates cam 22 and the scissor arms 24a and 24b in the unlocked position. In the unlocked position the translation slot 52 will cause the ends of the translation portions 53a and 53b to be aligned over each other such that the engagement ends 55a and 55b of bottom portions 54a and 54b respectively will also overlap. When in the open position the engagement ends 55a and 55b can be inserted into the adapter hole in the portable computer or other portable objects.

FIG. 11 illustrates cam 22 and the scissor arms 24a and 24bin the locked position. In the locked position the translation slot 52 will cause the ends of the translation portions 53a and 53b to not be aligned over each other and spaced apart from each other such that the engagement ends 55a and 55b of bottom portions 54a and 54b respectively will be linearly moved apart. When in the closed position the engagement ends 55a and 55b can not be removed out of the adapter hole in the portable computer or other portable objects. Further the engagement ends and the scissor arms may be so designed that when in the closed position the engagement ends 55a and 55b come into contact with the sides of the adapter hole and/or the inside of the housing having the adapter hole.

In that the cable 40 is not permanently attached to the cable adapter 30, the cable may first be secured to a structure.

FIG. 12 illustrates such a connection by passing eye connector 41 of the cable 40 first through a holding bracket 72 on structure 70 and then through eye connector 42 of cable 40. Eye connector 41 of cable 40 may then be inserted in eye connector housing 62 in cable adapter 30.

FIG. 13 illustrates another such connection passing eye connector 41 of the cable 40 first through structure 70 and then through eye connector 42 of cable 40. Eye connector 41 of cable 40 may then be inserted in eye connector housing 62 in cable adapter 30.

While the invention has been particularly shown and described with references to the preferred embodiments thereof, it will be understood by those skilled in the art that changes in form and detail may be made therein without departing from the spirit and scope of the invention. Given the above disclosure of general concepts and specific embodiments, the scope of the protection sought is defined by the following.

What is claimed is:

1. A scissor locking unit within a device for securing a first object having an aperture to a second object, said scissor locking unit comprising:

a locking mechanism having a shaft that is rotated between an unlock position and a lock position;

a cam connected to said shaft for rotation with said shaft between said unlock position and said lock position; and a scissor pivot assembly connected to said cam for translating the rotary motion of said cam into linear motion of a pair of scissor arms about a pivot pin in said scissor pivot assembly, where said pair of scissor arms will be in an overlapping closed position when said locking mechanism is in said unlock position for allowing said scissor arms to be inserted into said aperture in said first object and where said pair of scissor arms will be in a spread apart open position when said locking mechanism is in said lock position preventing said scissor arms from being removed from said first object through said aperture in said first object so as to secure said device to said first object.

2. The scissor locking unit of claim 1 wherein each scissor arm of said pair of scissor arms comprises:

a bottom portion having an engagement end for making contact with said object when said scissor arm is inserted into said first object through said aperture in said first object and said locking mechanism in said lock position; and a translation portion bent away from a vertical plain associated with said bottom portion, an end of said translation portion being movably connected to said cam for causing said scissor arm to move linearly along a line as said cam is rotated by said shaft.

3. The scissor locking unit of claim 2 wherein said translation portion is in the form of a truncated triangle.

4. The scissor locking unit of claim 1 further comprising:

a sleeve for housing a part of said locking mechanism, said cam and said scissor pivot assembly.

5. The scissor locking unit of claim 1 wherein:

said shaft has a first geometric shape comprising at least three sides: and said cam includes:

a compartment having said first geometric shape for receiving said shaft and for providing movement of said cam in response to movement of said shaft; and a translation slot extending through a center of rotation of said cam for receiving said pair of said scissor arms such that each scissor arm is located within said translation slot on a different side of said center of rotation of said cam.

6. A device for securing a first object having an aperture to a second object, said device comprising:

a scissor locking unit for securing said device to said first object, said scissor locking unit comprising:

a locking mechanism having a shaft that is rotated between an unlock position and a lock position;

a cam connected to said shaft for rotation with said shaft between said unlock position and said lock position; and a scissor pivot assembly connected to said cam for translating the rotary motion of said cam into linear motion of a pair of scissor arms about a pivot pin in said scissor pivot assembly, where said pair of scissor arms will be in an overlapping closed position when said locking mechanism is in said unlock position for allowing said scissor arms to be inserted into said aperture in said first object and where said pair of scissor arms will be in a spread apart open position when said locking mechanism is in said lock position preventing said scissor arms from being removed from said first object through said aperture in said first object so as to secure said device to said first object; and a cable adapter for first receiving and housing within said cable adapter a connector attached to an end of a cable and then for receiving said scissor locking unit so as to prevent said connector from being removed from said cable adapter when said scissor locking unit is received by said cable adapter and where said connector attached to said end of said cable being removable from said cable adapter whenever said scissor locking unit is not received by said cable adapter and said scissor locking unit is removable from said cable adapter whenever said scissor locking unit is not securing said device to said first object.

7. The device of claim 6 wherein:

said scissor locking unit has an upper lock portion having a first diameter and a second portion having a first length and a second diameter where said second diameter is smaller than said first diameter; and said cable adapter has a ring shaped portion wherein the inner diameter of said ring shaped portion is greater than said second diameter and less than the first diameter such that said cable adapter can receive said second portion of said scissor locking unit and said cable adapter is captured between said top portion of said scissor locking unit and said first object when said scissor locking unit secures said device to said first object.

8. The device of claim 7 wherein said cable adapter further comprises:

a cable housing for receiving and housing said connector attached to said end of said cable.

9. The scissor locking unit of claim 6 wherein each scissor arm of said pair of scissor arms comprises:

a bottom portion having an engagement end for making contact with said object when said scissor arm is inserted into said first object through said aperture in said first object and said locking mechanism in said lock position; and a translation portion bent away from a vertical plain associated with said bottom portion, an end of said translation portion being movably connected to said cam for causing said scissor arm to move linearly along a line as said cam is rotated by said shaft.

10. The scissor locking unit of claim 9 wherein said translation portion is in the form of a truncated triangle.

11. The scissor locking unit of claim 9 further comprising:

a sleeve for housing a part of said locking mechanism, said cam and said scissor pivot assembly.

12. The scissor locking unit of claim 9 wherein:

said shaft has a first geometric shape comprising at least three sides; and said cam includes:

a compartment having said first geometric shape for receiving said shaft and for providing movement of said cam in response to movement of said shaft; and a translation slot extending through a center of rotation of said cam for receiving said pair of said scissor arms such that each scissor arm is located with said translation slot on a different side of said center of rotation of said cam.

* * * * *